US005217298A

United States Patent [19]

Jackson et al.

[11] Patent Number: 5,217,298

[45] Date of Patent: Jun. 8, 1993

[54] LIGHTING SYSTEM

[75] Inventors: Randall E. Jackson, 2415 Goebbert Rd., Arlington Heights, Ill. 60005; Jerri M. Wilson, Arlington Heights, Ill.

[73] Assignee: Randall E. Jackson, Arlington Heights, Ill.

[21] Appl. No.: 803,106

[22] Filed: Dec. 5, 1991

[51] Int. Cl.[5] ..... F21V 21/06

[52] U.S. Cl. ..... 362/226; 362/249; 362/410

[58] Field of Search ..... 362/226, 249, 250, 431, 362/410, 388, 801; 439/110, 113

[56] References Cited

U.S. PATENT DOCUMENTS 2,977,566 3/1961 Neumann et al. ..... 362/431 X 3,985,924 10/1976 Pritza ..... 362/431 X

*Primary Examiner*—Richard R. Cole

*Attorney, Agent, or Firm*—Wallenstein, Wagner & Hattis, Ltd.

[57] ABSTRACT

A lighting system (10) is disclosed comprising a free-standing base (12) supporting a track lighting strip (20) in a substantially vertical position. Lighting elements (38) may be positioned at any point along the track lighting strip. Spacer tubes (80) and protective elements (90) cover and enclose the track lighting strip.

3 Claims, 4 Drawing Sheets

LIGHTING SYSTEM

TECHNICAL FIELD

The present invention generally relates to a lighting system and more particularly to a vertical, free standing lamp structure utilizing a track lighting strip.

BACKGROUND PRIOR ART

Track lighting systems are commonly used to provide unique and changeable decorative lighting displays. Typically, a large variety of track lighting lamps can be quickly installed at any of a number of positions and angles along a track lighting strip by snapping a specially adapted mounting connected to the lamp into an open conductive channel element on the strip. These lamps may be removed, replaced and repositioned with little effort. This allows for a great deal of flexibility in creating and changing the lighting display.

However, track lighting strips are typically either mounted to a surface, such as a ceiling or a wall, or are suspended from the ceiling. Thus, once mounted the strip becomes a permanent fixture and cannot easily be repositioned. A traditional, standing floor lamp, on the other hand, can be easily moved from position to position as desired. Unfortunately, a floor lamp does not have the lighting flexibility associated with track lighting. Thus, a need exists for a lighting system having the mobility of a floor lamp and the flexibility and versatility of track lighting.

SUMMARY OF THE INVENTION

The lighting system of the present invention combines the mobility of a floor lamp with the flexibility and versatility of track lighting. The lighting system comprises a transportable base which supports at least one track lighting strip in a substantially vertical position. The track lighting strip can be a conventional strip, having an open, front, conductive channel element and a open, rear, mounting channel element, which normally would be mounted to a wall or ceiling. The rear mounting channel element does not have to be removed or modified for the present lighting system to operate properly, however, the rear mounting channel element is not necessary for the operation of the lighting system. Thus, a track lighting strip without a rear mounting channel element can be used. Lighting members, such as one or more track lighting lamps, can be installed at any of a number of positions and angles along the track lighting strip. The lighting system can be easily moved from one position to another in a manner similar to a floor lamp.

The lighting system may also include spacer tubes having a hollow, generally cylindrical shape. The spacer tubes can be positioned around the track lighting strip between lighting members installed on the strip or between either the top or base and a lighting member. The spacer tubes perform the dual functions of protecting against accidental shock resulting from contact with an exposed portion of the track lighting strip and providing a decorative, aesthetically pleasing lighting display. The spacer tubes cover and shield unused track strip areas, leaving exposed areas only in the vicinity immediately surrounding the lighting members installed along the track lighting strip. The outer surface of the spacer tubes may be artistically configured in an infinite variety of shapes and colors. The spacer tubes can be shaped, for example, as Greek columns, trees, or as solid colored or patterned poles. Thus, the spacer tubes can be exchanged to match the color scheme and style of any area without the need for purchasing an entire new lighting system.

The spacer tubes can be used to provide additional versatility to the lighting system. This is done by providing a plurality of spacer tubes having a variety of lengths. This enables the spacer tubes to be coordinately used with any number of lighting members installed along the track lighting strip. By providing spacer tubes having a variety of lengths, the lighting members can be installed at any position along the track lighting strip, repositioned, removed or added while still maintaining the ability to cover the exposed areas of the track lighting strip. Thus, a lighting system can be custom designed or redesigned by utilizing a plurality of spacer tubes having appropriate lengths.

Protective elements, preferably having outward characteristics which match the spacer tubes, can be utilized to cover the exposed areas immediately surrounding the lighting members positioned along the track lighting strip. These protective elements can be secured to the lighting system by resilient clips or friction fit.

In a separate embodiment, the protective elements may be made integrally a part of the end portions of the spacer tubes. Furthermore, the spacer tubes can be formed having openings between the end portions of the tubes sized so that a lighting member may be installed along the track lighting strip through the opening.

A first spacer tube, usually located between the base and a lighting member positioned lowest on the track lighting strip, is supported by the base. Subsequent spacer tubes, located between lamps or between the highest positioned lighting member and the top of the light system, are supported by attachable clamps secured to the track lighting strip or, alternatively, directly by the lighting member positioned on the track lighting strip. When used with the protective elements, subsequent spacer tubes may rest directly upon the protective elements.

A cap may be secured to the top end of the track lighting strip. This encloses the track lighting strip and prevents dust and other objects from entering the spacer tubes.

The lighting system may further comprise additional track strips. For instance, two track lighting strips may be positioned back to back with their mounting channel elements placed adjacent to each other and their open conductive channel elements facing outwardly in opposing directions. Similarly, three strips may be positioned so that they form a triangular cross-section with their open conductive channel elements facing outwardly.

Also, using conventional track lighting connecters, an additional track lighting strip may be connected at either end to two of the lighting systems described, or to a lighting system and a mounted strip. This idea can be carried even further to create elaborate lighting structures having a plurality of lighting systems connected by horizontally positioned track lighting strips.

DETAILED DESCRIPTION OF A PREFERRED EMBODIMENT

Figure 1:
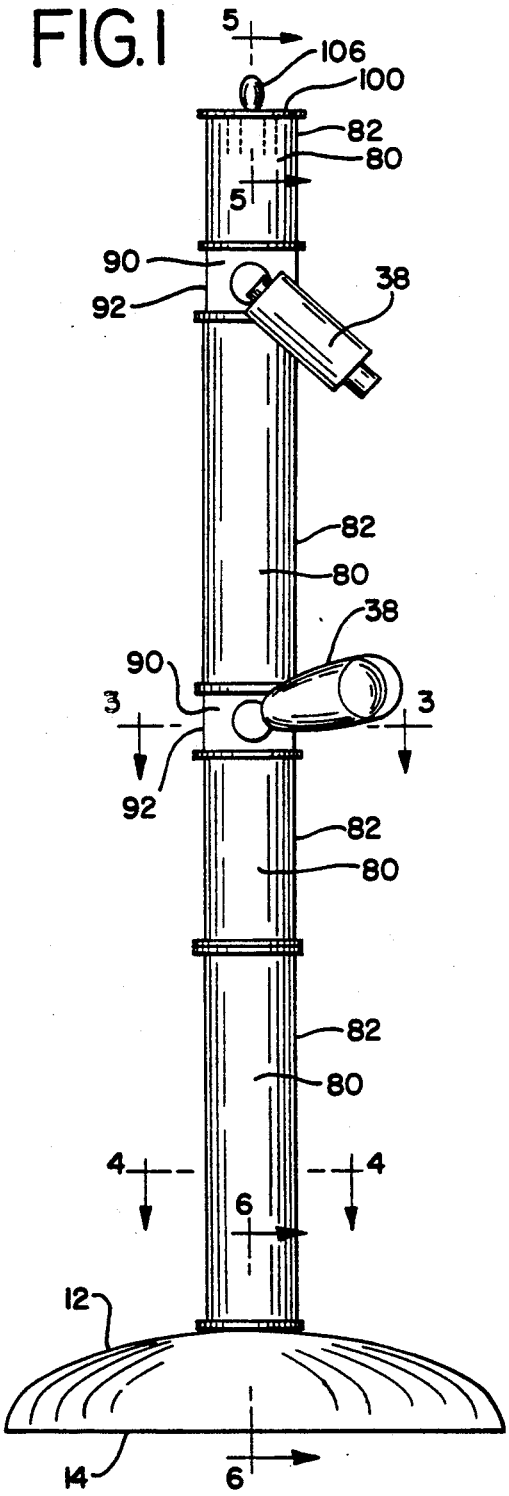
FIG. 1 discloses a perspective side view of the lighting system of the present invention.
Figure 2:
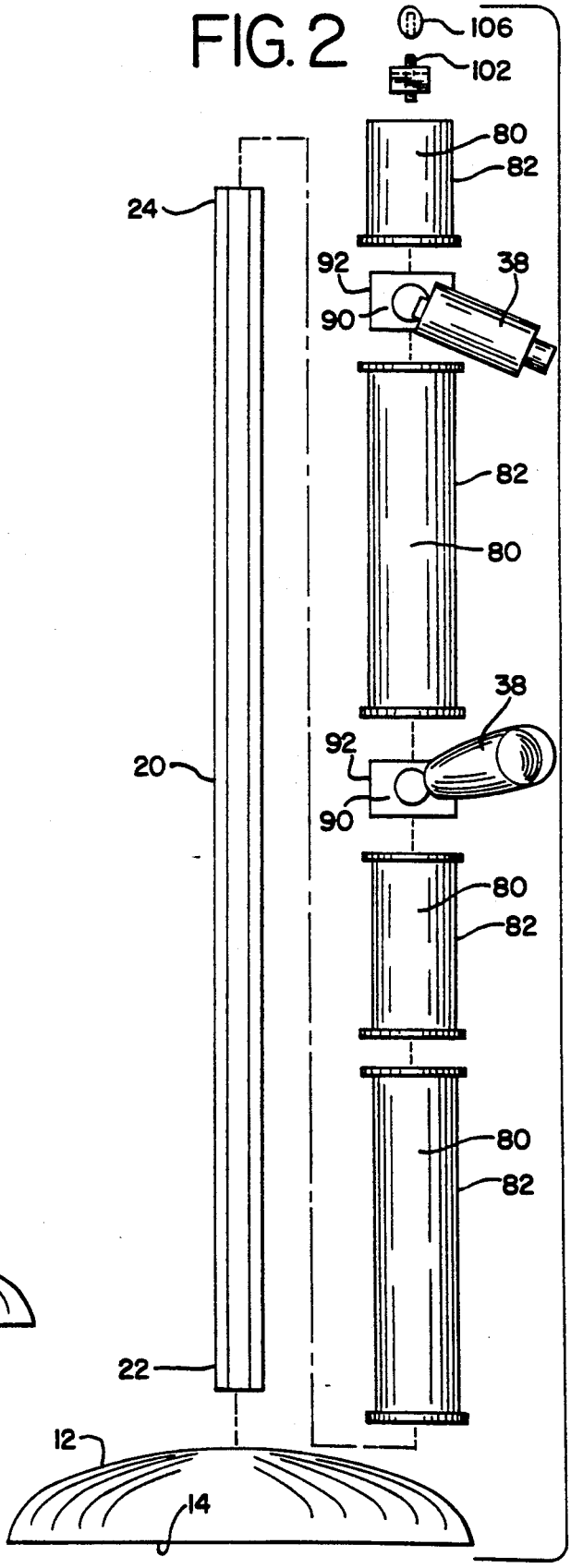
FIG. 2 discloses an exploded side view of the lighting system of FIG. 1.

While this invention is susceptible of embodiment in many different forms, there is shown in the drawings and will herein be described in detail a preferred embodiment of the invention. The present disclosure is to be considered as an exemplification of the principles of the invention and is not intended to limit the broad aspect of the invention to the embodiment illustrated.

A lighting system, generally designated by the reference number 10, is shown in FIG. 1. The lighting system 10 includes a base 12 having a generally planar bottom 14. The base 12 preferably supports the system's components on a floor. The center of the base 12 includes a recess 16 sized to receive a first and a second track lighting strip 20 and 21. The first track lighting strip 20, having a first end 22 and a second end 24, and the second track lighting strip 21, having a corresponding first end 22 and a second end 24, are supported in a substantially vertical position by the base 12. The first end 22 of the first track lighting strip 20 and the first end 22 of the second track lighting system 21 are positioned in the recess 16 of the base 12.

The track lighting strips 20 and 21 can be constructed from extruded aluminum into elongated channel members each having a first side having a conductive channel element 26 and a second side opposed from the first side having a mounting channel element 28. The conductive channel element 26 forms a first channel 30 and the mounting channel element 28 forms a second channel 32, respectively. The channels 30 and 32 extend the entire length of the track lighting strips 20 and 21 from each strips first end 22 to each strips second end 24. The second channel 32 formed in the mounting channel element 28 is sized to cooperate with a mounting component and is used primarily for mounting a track lighting strip to a surface. The first channel 30 formed in the conductive channel element 26 is sized to receive a mounting attachment 36 connected to a lighting element 38. The lighting element 38 can be any of a number of colors, shapes or styles currently available for use with track lighting strips.

The conductive channel element 26 forming the first channel 30, is generally U-shaped having a back wall segment 40, a first edge 42 and a second edge 44 opposed from the first edge 42; the back wall segment 40 extends the length of the conductive channel element 26. A first side wall segment 46 having a first edge 48 and second edge 50 opposed from the first edge 48 is positioned perpendicular to the back wall segment 40. The first edge 48 of the first side wall segment 46 is connected to the first edge 42 of the back wall segment 40 and the first side wall segment 46 extends outward from the back wall segment 40 in a direction opposed from the mounting channel element 26. A second side wall segment 52 having a first edge 54 and a second edge 56 opposed from the first edge 54 is also positioned perpendicular to the back wall segment 40. The first edge 54 of the second wall segment 52 is connected to the second edge 44 of the back wall segment 40 and the second side wall segment 52 extends outward from the back wall segment 40 in a direction opposed from the mounting channel element 26. The side wall segments 46, 52 extend the length of the conductive channel element 26. A first front wall segment 58 having a first edge 60 and a second edge 62 opposed from the first edge 60 are positioned perpendicular to the first side wall segment 46. The first edge 60 of the first front wall segment 58 is connected to the second edge 50 of the first side wall segment 46 and the first front wall segment 58 extends from the first side wall segment 46 towards the second side wall segment 52. A second front wall segment 64 having a first edge 66 and second edge 68 opposed from the first edge 66 is positioned perpendicular the second side wall segment 52. The first edge 66 of the second front wall segment 64 is connected to the second edge 56 of the second side wall segment 52 and the second front wall segment 64 extends from the second side wall segment 52 towards the first side wall segment 46. The second edge 62 of the first front wall segment 60 and the second edge 68 of the second front wall segment 64 are spaced apart from each other so as to define an open gap 70 for the conductive channel 30. The front wall segments 58, 64 extend the length of the conductive channel element 26. The back wall segment 40, the first and second side wall segments 46, 52 and the first and second front wall segments 60, 64 define the conductive channel 30.

An insulating layer 72, preferably made from a thermoplastic material, is positioned along the back wall segment 40, the first and second side wall segments 46, 52 and the first and second front wall segments 60, 64 along the inside of the conductive channel 30. The insulating layer 72 extends the length of the conductive channel element 26.

A first positive conductive wire 74 is positioned partially embedded into the portion of the insulating layer 72 positioned along the first side wall segment 46 of the conductive channel element 26 so that the first wire is partially exposed within the conductive channel 30. A second negative conductive wire 76 is positioned partially embedded into the portion of the insulating layer 72 positioned along the second side wall segment 52 of the conductive channel element 26 so that it also is partially exposed within the conductive channel 30. Both wires 74, 76 extend the length of the conductive channel element. It is possible to form the insulating layer 72 having lip elements (not shown) partially shielding the exposed portions of the wires 74, 76 to provide further protection against accidental shock. The conductive wires 74, 76 are preferably formed from copper. Electric power lines (not shown) are connected to the first and second wires 74, 76 at the first end 22 of the first track lighting system 20 and to the first and second wires 74, 76 at the first end of the second track lighting system 21. The power lines preferably run through the base 12 and can be connected to an ordinary wall socket. The power lines and wires 74, 76 supply electricity for the lighting elements 38.

The mounting channel element 28 is constructed in a similar manner as the conductive channel element 26 to define the mounting channel 32. However, the mounting channel element 28 is constructed without an insulating layer or conductive wires. While the preferred embodiment shows the use of two conventional track lighting strips having mounting channel elements, it can be appreciated by one skilled in the art that the mounting channel elements are not necessary to the operation of the invention and may be removed. It should also be appreciated that a single track lighting strip having opposing conductive channel elements can be constructed and substituted for the two conventional track lighting strips.

The track lighting strips 20 and 21 are positioned so that the mounting channel 28 of the first track lighting strip 20 is adjacent the mounting channel element 28 of the second track lighting strip 21. Thus, conductive channels elements 26 of the track lighting strips 20 and 21 are outwardly disposed and facing opposite directions. Each track lighting strip 20 and 21 is approximately six to eight feet in length from their first ends to their second ends.

Lighting elements 38 having mounting attachments 36 can be installed at any position along the conductive channel elements 26 of the first and second track lighting strips 20, 21. The mounting attachments 36 can be inserted into the open gaps 70 of the conductive channels 30 and frictionally secured in place so that terminals 75, 77 on the attachments 36 come into contact with the conductive wires 74, 76, respectively.

The lighting system 10 includes a plurality of spacer tubes 80 disposed around the track lighting strips 20 and 21. The spacer tubes 80 of the preferred embodiment have a generally cylindrical exterior surface 82, a generally cylindrical interior surface 84 and define a hollow tube. However, the spacer tubes may be constructed having a large variety of shapes. The spacer tubes 80, in addition to their decorative function, enclose the exposed segments of the track lighting strips 20 and 21, and prevent any possibility of accidental electric shock.

The spacer tubes 80 can be formed having varying lengths. This allows for a great deal of flexibility in the positioning of the lighting elements 38 along the track lighting strips 20, 21. The lighting elements 38 can be positioned, reposition, removed or added to the lighting system while still maintaining the ability to cover exposed areas of the track lighting strips 20, 21 located between installed lighting elements 38.

Figure 3:
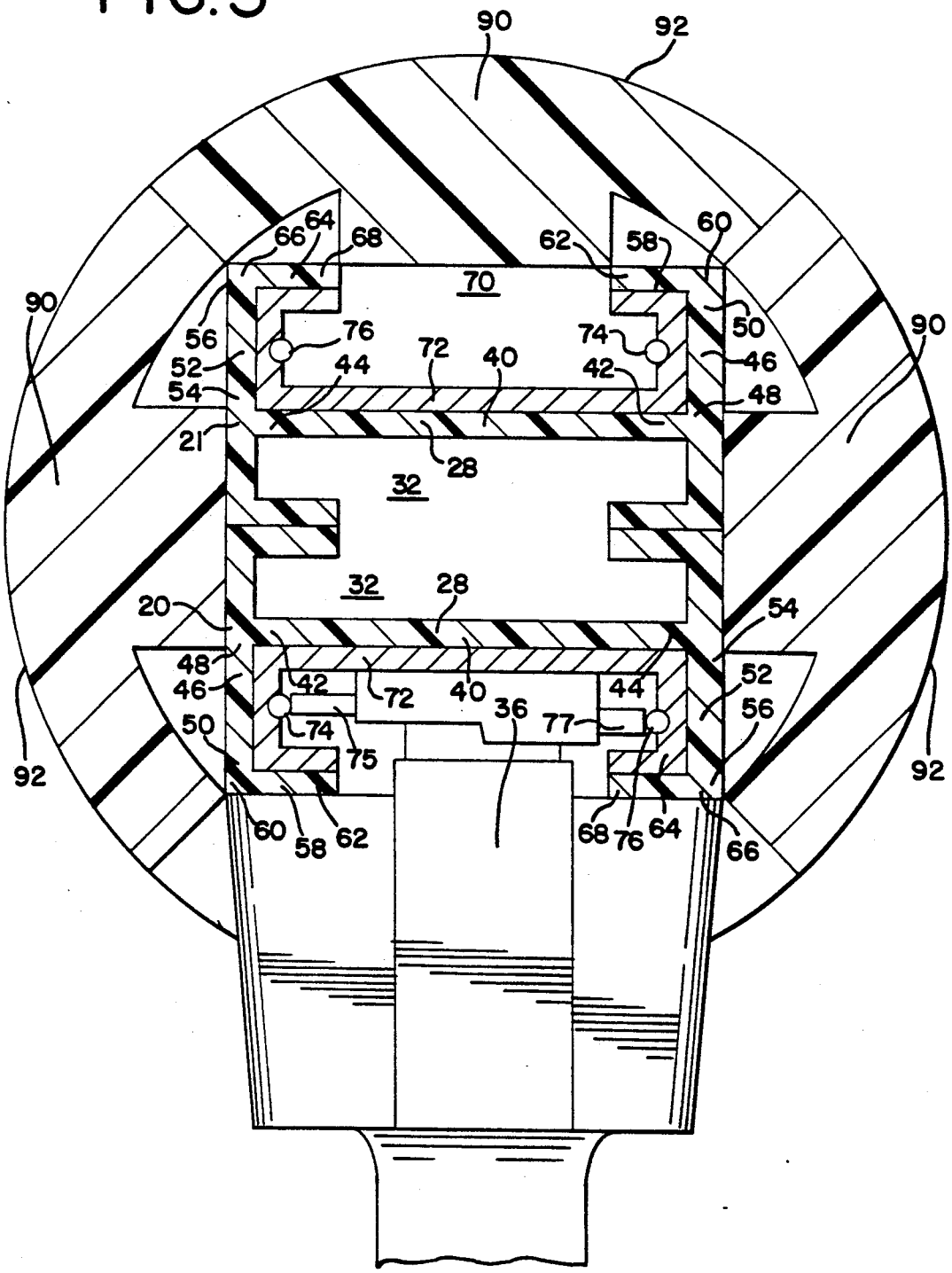
FIG. 3 is a cross-sectional view taken along line 3—3 of the lighting system shown in FIG. 1.
Figure 4:
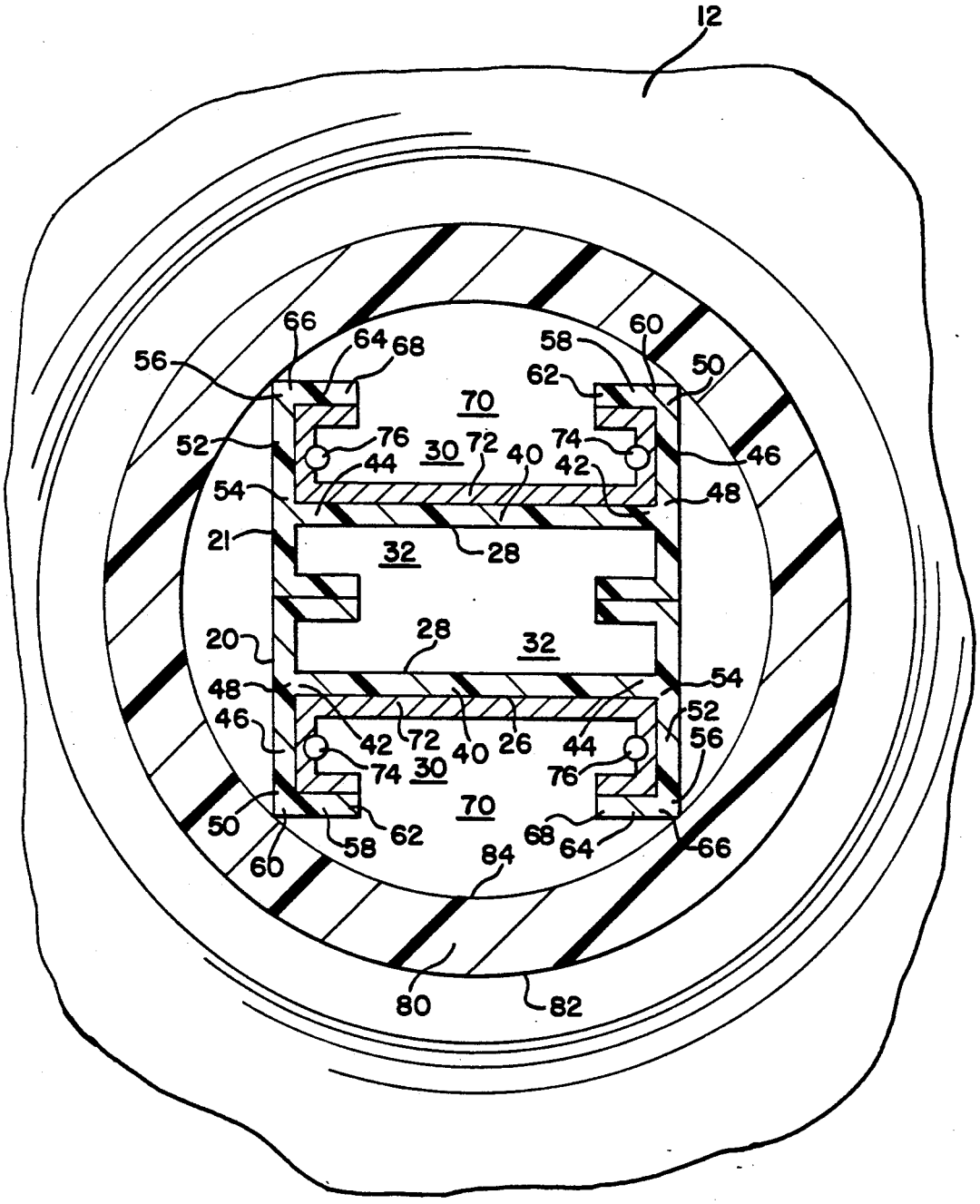
FIG. 4 is a cross-sectional view taken along line 4—4 of the lighting system shown in FIG. 1.
Figure 5:
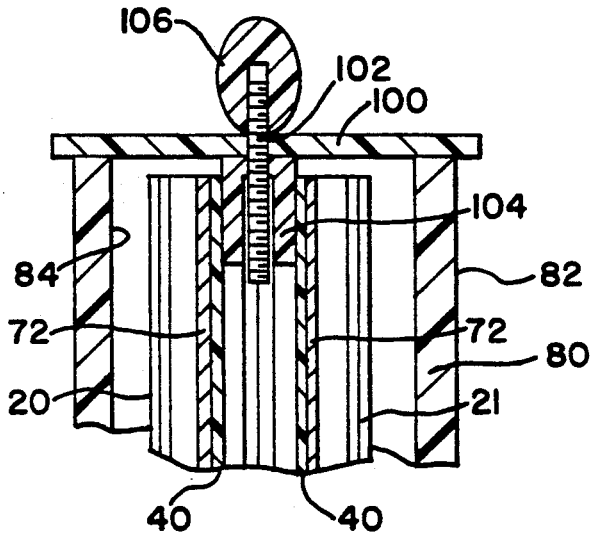
FIG. 5 is a cross-sectional view taken along line 5—5 of the lighting system shown in FIG. 1; and, FIG. 6 is a cross-sectional view taken along line 6—6 of the lighting system shown in FIG. 1.
Figure 6:
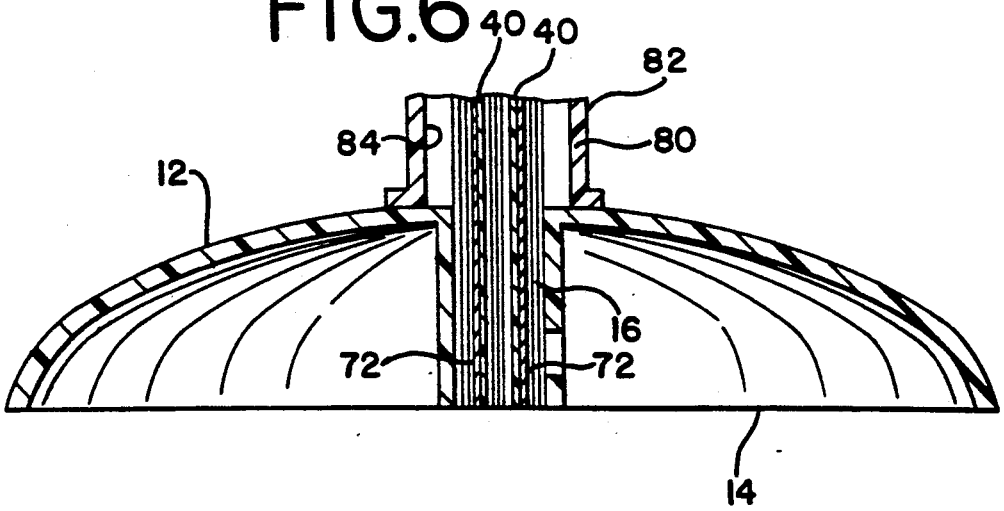

Protective elements 90, shown in cross-section in FIG. 3, surround the track lighting lamps 38 positioned on the first track lighting strip 20 in exposed areas not covered by the spacer tubes 80. The protective elements 90 have outward surfaces 92 which artistically conform to the outward surfaces of the spacer tubes 80. The protective elements 90 can be formed into one integral piece covering the entire exposed area or into three separate elements as shown. The advantage of utilizing three separate elements 90 is that another lighting element 38 may be positioned on the second track lighting strip 21 by simply removing the protective element 90 covering the conductive channel element 26 of the second track lighting strip 21. The protective elements 90 are secured to the lighting system by resilient clips or friction fit.

While the spacer tubes 80 of the preferred embodiment are cylindrical in shape and thus necessarily leave exposed areas of the track lighting strips 20, 21 immediately surrounding an installed lighting element 38, it can be appreciated that the tubes can be formed with protective elements integrally a part of the tube.

A cap 100 is secured to the top of the lighting system 10, and thereby fully encloses the track lighting strips 20 and 21. The cap 100 is secured by a threaded member 102 connected at one end to an element 104 secured to the top ends 24 of the track lighting strips 20, 21 and to a knob 106 at another end.

While a specific embodiment has been illustrated and described, numerous modifications come to mind without significantly departing from the spirit of the invention and the scope of protection is only limited by the scope of the accompanying claims.

What I claim is:

1. A lighting system comprising:

a base:

a first substantially vertical track lighting strip supported by said base and having a conductive channel element including a conductive element for supplying electricity;

a second substantially vertical track lighting strip supported by said base and having a conductive channel including a conductive element for supplying electricity;

a first spacer tube disposed around said first strip and said second strip;

a second spacer tube disposed around said first strip and said second strip;

a lighting element connected to said first strip contacting said conductive element, said lighting element positioned between and spacing apart said first spacer tube and said second spacer tube; and, means for providing electricity to said conductive elements.

2. The lighting system of claim 1 wherein said base includes a recess adapted to receive and support said track lighting strips.

3. The lighting system of claim 2 further comprising another lighting element connected to said second track lighting strip contacting said conductive element.

* * * * *